United States Patent [19]

Wilson

[11] Patent Number: 4,560,158

[45] Date of Patent: Dec. 24, 1985

[54] BOTTOM SHEET SEPARATOR-FEEDER

[75] Inventor: Lionel A. Wilson, Hitchin, England

[73] Assignee: Xerox Corporation, Stamford, Conn.

[21] Appl. No.: 534,013

[22] Filed: Sep. 20, 1983

[30] Foreign Application Priority Data

Sep. 21, 1982 [GB] United Kingdom ..... 8226848

[51] Int. Cl.[4] ..... B65H 1/06; B65H 3/12

[52] U.S. Cl. ..... 271/165; 271/3.1; 271/94; 271/98

[58] Field of Search ..... 271/94, 3.1, 11, 20, 271/35, 90, 97, 98, 99, 104, 105, 106, 112, 132, 133, 161, 165, 166, 167, 188, 209, 276

[56] References Cited

U.S. PATENT DOCUMENTS

| | | | |
|---|---|---|---|
| 4,269,406 | 5/1981 | Hamlin | 271/108 |
| 4,270,746 | 6/1981 | Hamlin | 271/98 |
| 4,275,877 | 6/1981 | Silverberg | 271/166 |
| 4,284,270 | 8/1981 | Silverberg | 271/166 |
| 4,305,576 | 12/1981 | Hamlin | 271/11 |
| 4,313,599 | 2/1982 | Lohr | 271/166 |
| 4,411,417 | 10/1983 | Browne | 271/165 X |

FOREIGN PATENT DOCUMENTS 0030410 6/1981 European Pat. Off. .

*Primary Examiner*—George E. A. Halvosa
*Assistant Examiner*—Lawrence J. Goffney, Jr.
*Attorney, Agent, or Firm*—William A. Henry, II

[57] ABSTRACT

A bottom sheet separator-feeder for separating and forwarding sheets seriatim from the bottom of a stack of sheets to be fed. It comprises a stack tray defining a surface for supporting a stack of sheets to be fed, the tray having a depressed control portion in at least the front part of the surface. Vacuum feed belts are disposed in the pocket to pull the bottom sheet in the stack into the pocket and feed the sheet from beneath the stack. An air injection knife disposed adjacent the front of the tray injects air between the bottom sheet in the stack and the tray and between the bottom sheet and the remainder of sheets in the stack. Ramps are provided at the front ends of the tray at each side of the pocket for raising the lead edges of the sheets in the stack above the support surface to control multifeeds and misfeeds of downcurled sheets.

5 Claims, 8 Drawing Figures

BOTTOM SHEET SEPARATOR-FEEDER

Figure 1:
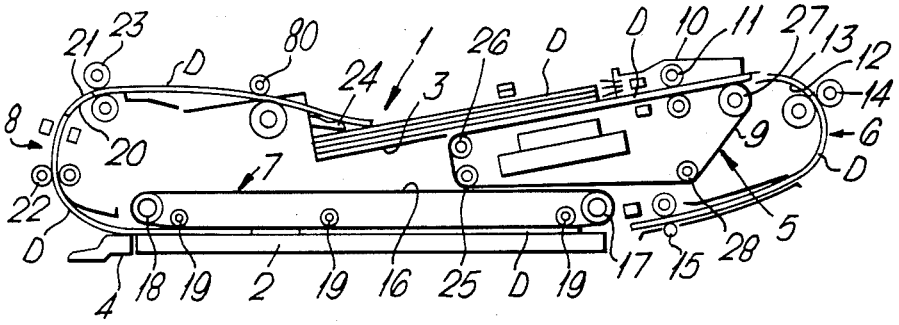

This invention relates to bottom sheet separator-feeders for separating and forwarding sheets seriatim from the bottom of a stack of the sheets. The invention is particularly concerned with such separator-feeders which include vacuum means for performing the separating and forwarding functions.

U.S. Pat. Nos. 4,269,406, 4,270,746, 4,275,877, 4,284,270, 4,305,576 and 4,313,599 disclose bottom sheet separator-feeders for separating and forwarding sheets seriatim from the bottom of the stack of sheets to be fed, comprising a stack tray defining a surface for supporting a stack of sheets to be fed, said tray having a depressed central portion forming a pocket in at least the front part of said surface, vacuum feed means disposed in the pocket so as to pull the bottom sheet in the stack into the pocket and feed the sheet from beneath the stack, and air injection means disposed adjacent the front of the tray to inject air between the bottom sheet in the stack and said tray and between the bottom sheet and the remainder of sheets in the stack.

With such separator feeders, particularly when operated at slow speeds such as when it is required to feed a document to a platen of a photocopier at a controlled speed, there is a tendency for downcurled sheets to become shingled. This occurs because of the increased friction between the sheets due to the curl and because the curl tends to inhibit the flow of air from the air injection means between the bottom sheet and the next sheet. As the shingling occurs this latter effect is exacerbated since the lead edges of the sheets move closer to the air injection means.

In order to alleviate this problem, the present invention is characterised by means at the front end of said tray at each side of said pocket for raising the lead edges of the sheets in a said stack in said tray above said support surface.

In a preferred form the sheet lead edge raising means comprises upwardly sloping surfaces which project forwardly of the normal lead edge stacking position of sheets in the tray so that forward movement of the second sheet is positively retarded by the upward slope.

The raising means may comprise narrow ramps adjacent each side of the pocket or wide ramps which extend right across the front end of the support surface at each side of the pocket. Or the front end of the support surface at each side of the pocket may be formed with an upward slope so that it is raised above the remainder of the surface.

In one embodiment, the tray slopes upwardly towards its front end and has a depressed pocket formed therein through which endless vacuum feed belts extend across a vacuum plenum having vacuum ports therein for applying a negative pressure at the back of the belts. A portion of the centre belt is spaced slightly above the remaining belts such that when the bottom sheet in the stack is pulled down into contact with the belts a temporary corrugation is formed in the sheet so that the sheet assumes a W-configuration. The vacuum belts are supported on the top surface of the vacuum plenum and the centre belt passes over a raised portion of that surface. The centre belt is preferably not a vacuum belt. The air injection means comprises an air knife having a plurality of spaced discharge orifices therein opposite the pocket which provide a plurality of diverging and expanding air streams.

Figure 2:
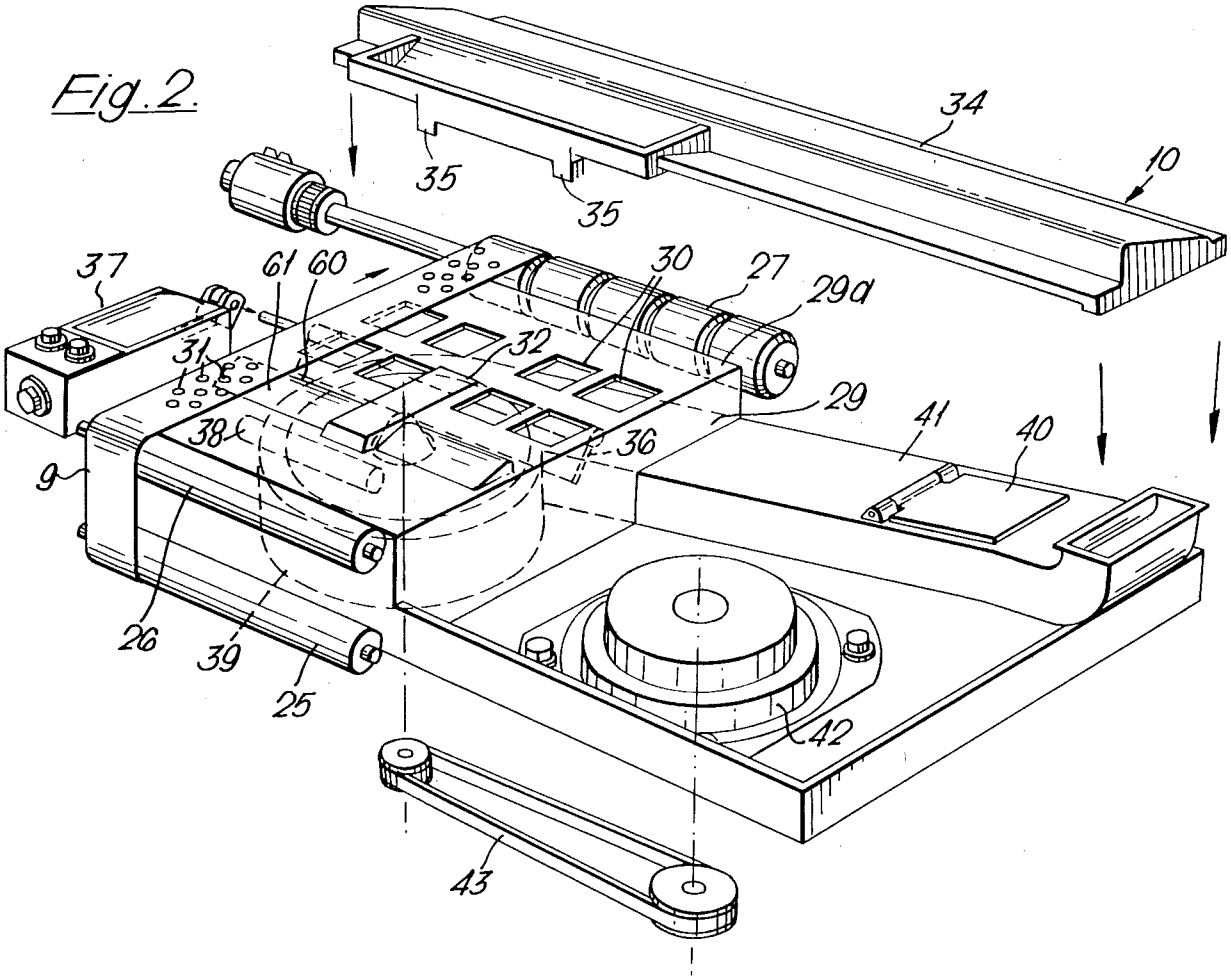
Figure 3:
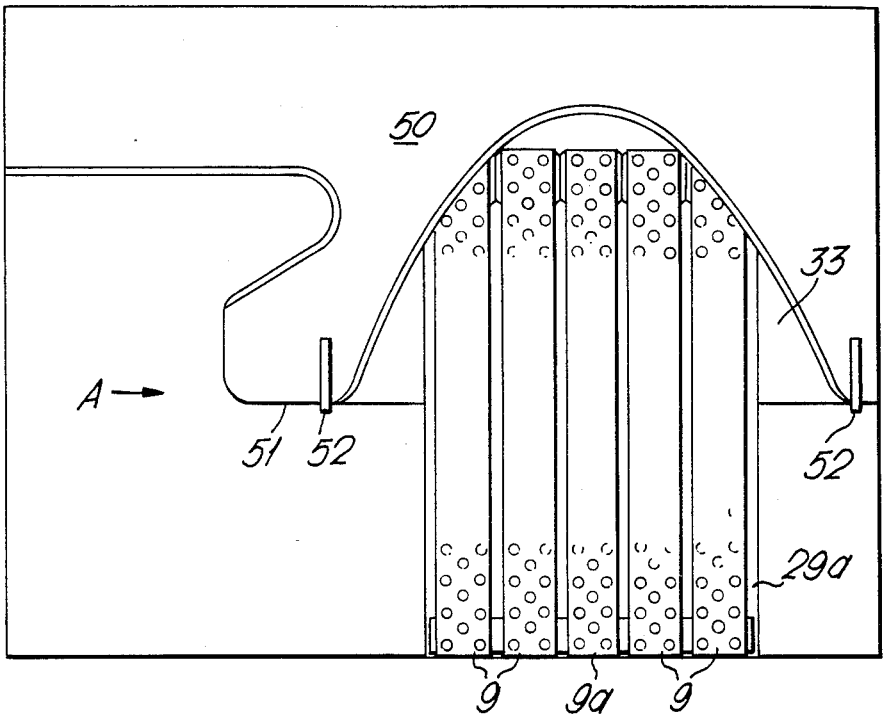
Figure 4:
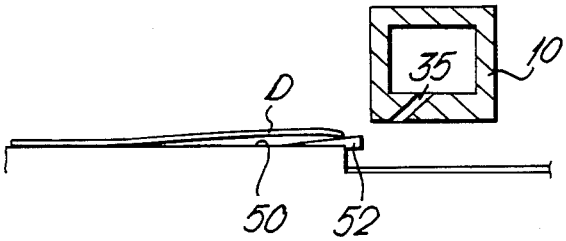
Figure 5:
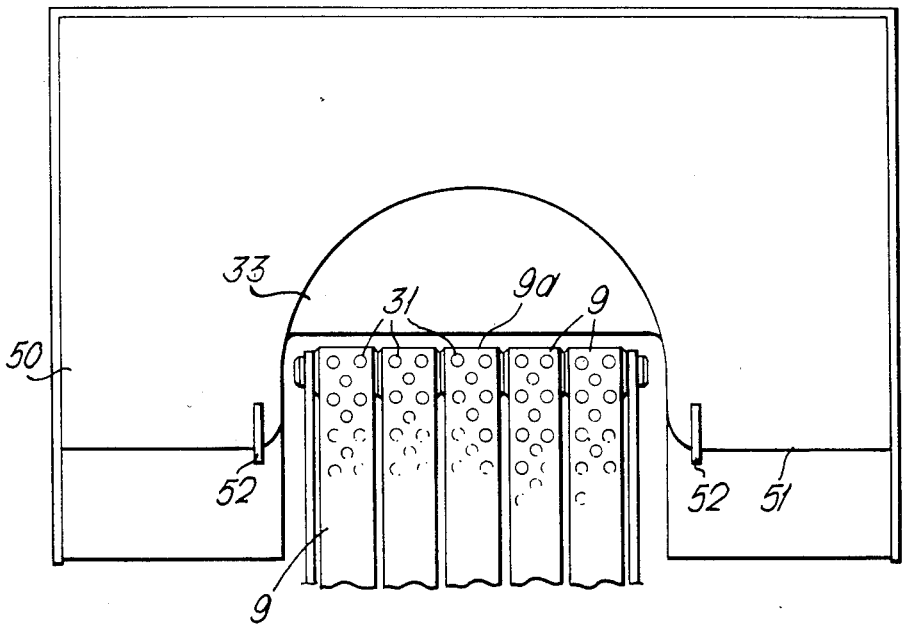
Figure 6:
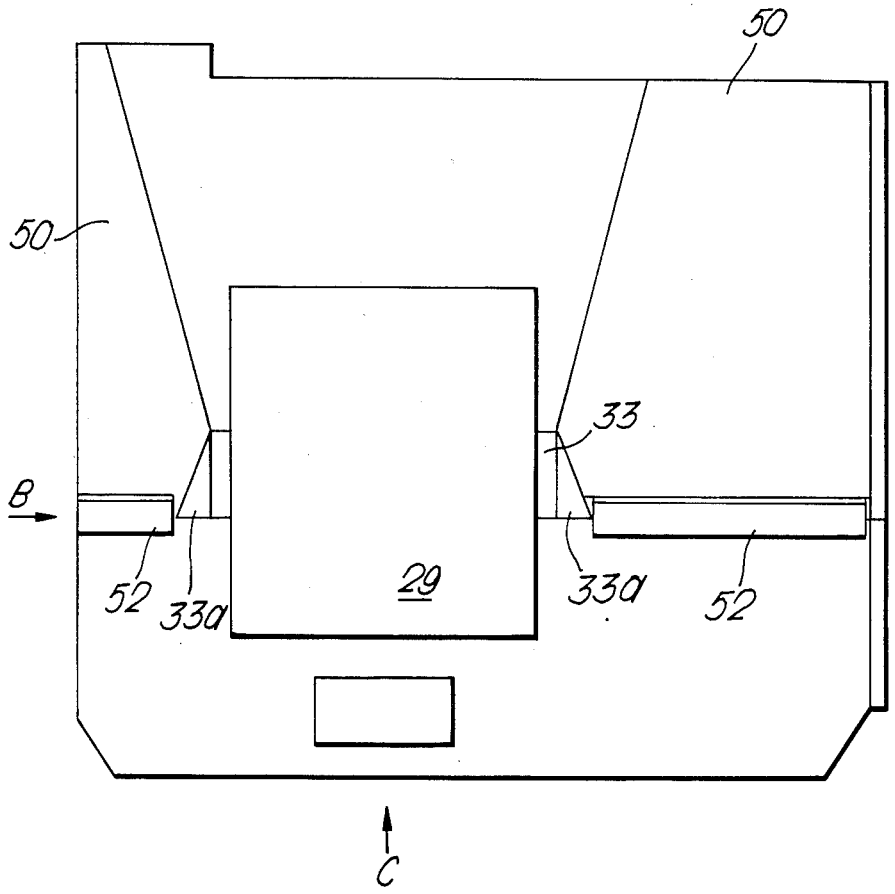
Figure 7:
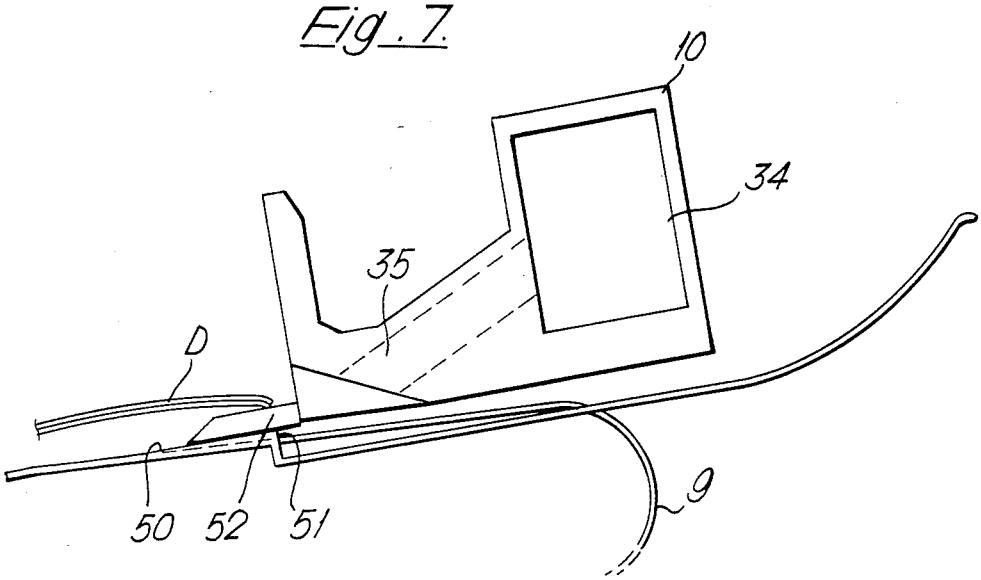
Figure 8:
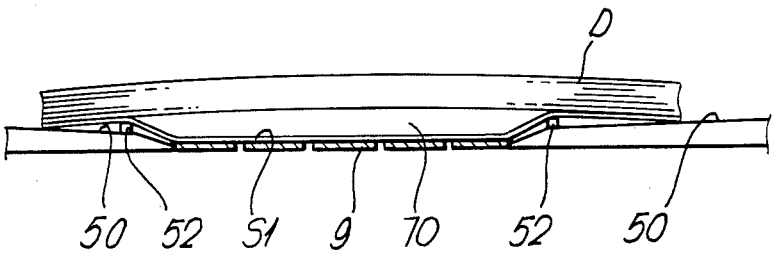

In order that the invention may be more readily understood reference will now be made to the accompaying drawings, in which:

FIG. 1 is a schematic side view of a document handler incorporating a bottom sheet separator-feeder according to the invention, FIG. 2 is a perspective view, partly exploded, of the separator feeder mechanism of the document handler of FIG. 1, FIG. 3 is a top plan view of the document tray and feed belts of the document handler, FIG. 4 is a scrap section in the direction of arrow A in FIG. 3, FIG. 5 is a top plan view of a second embodiment, FIG. 6 is a top plan view of a third embodiment, FIG. 7 is a scrap side view in the direction of arrow B in FIG. 6, and FIG. 8 is a scrap section in the direction of arrow C in FIG. 6.

Referring to the drawings, there is illustrated an automatic document handler 1 for installation above the exposure platen 2 of a xerographic reproduction machine. The document handler includes a storage tray 3 for a stack of documents D to be copied and document circulating means for delivering the documents in turn to the platen from the storage tray and for returning the documents to the tray, whereby the documents may be circulated and recirculated in sequence past the platen for repeated copying (precollation mode). The documents may either be transported across the platen at a constant velocity past the optical system (not shown) of the photocopier which is held stationary with its scanning slit under the entry end of the platen, or instead they may be registered on the platen prior to copying and the stationary document exposed by scanning the optical system across the document. For this purpose a registration member or gate 4, which can be moved in and out of sheet blocking position at the registration edge of the platen by means of a conventional solenoid type actuator, is provided for registering the document in stationary position on the platen 2 while the optical system is scanned across the document. When the document is registered on the platen, the document handler can be operated in so-called stacks mode wherein each document is copied a plural number of times during a single delivery to the platen.

The document handler comprises, in addition to the document tray 3, a document separator/feeder 5, a pre-platen transport 6 for conveying documents to the platen, a platen transport 7 and a post-platen transport 8 by which documents are returned to the document tray.

The document storage tray 3 is mounted over the platen 2 and slopes upwardly towards the separator/-feeder 5; it is adjustable to accommodate different document sizes.

Sheet separation and acquisition is accomplished by a vacuum belt corrugation feeder (VCF) 5 using flotation pressure differences between the bottom sheet and the sheets above, sheet corrugation and vacuum, a parabolic contour pocket being cut out at the lead edge of the tray 3 and dished down in the manner shown and described for example in U.S. Pat. No. 4,275,877. Documents placed in the tray, bridge this gap and form a flotation pocket. Transport belts 9 surface through the document tray within the contour pocket. Document stack flotation is accomplished by a frontal assault of air from an air knife 10. The air jet impinges on the tray just in front of the lead edge of the document stack; this permits volumetric flow expansion of air within the pocket contour of the tray and also riffles the front edge of the documents to allow a differential pocket of air between the bottom sheet and the next sheet. This assists in the acquisition, separation and feeding of the bottom document.

The vacuum belt corrugation feeder mechanism 5 acquires and corrugates the bottom document D in the stack and forwards the document to take away roll pair 11 after the air knife 10 has had time to separate the bottom sheet from the rest of the stack. The document is then fed by take-away rolls 11 through pre-platen transport 6 which comprises inner and outer inversion guides 12, 13 and feed roll pairs 14 and 15. Transport of the document across the platen 2 is by a single white, wide friction drive belt 16 entrained over input and output rollers 17, 18. Three gravity rolls 19 apply a nip between the belt 16 and platen 2 and maintain drive across the platen. The post-platen transport 8 by which the document is returned to the document tray 3 after exposure comprises inner and outer inversion guides 20, 21 and feed roll pairs 22, 23 as well as a re-entry roll pair 80 for driving the documents back into the tray.

The document handler is also provided with a sheet separator finger 24 as is well known in the art to separate the documents to be fed from those documents returned to the document handler. Upon removal of the last document from beneath sheet separator finger 24, the finger 24 drops through a slot provided in the tray, suitable sensors are provided to sense that the last document in the set has been removed from the tray and the finger is then rotated in a clockwise direction to again come to rest on the top of the documents in the stack prior to subsequent recirculation of the document set.

Referring more particularly to FIGS. 2, 3 and 4 wherein the document separator-feeder 5 is more clearly illustrated, there is disclosed a plurality of feed belts 9 supported for movement on feed belt rolls 25, 26, 27 and 28. Spaced within the run of the belts 9 there is provided a vacuum plenum 29 having vacuum openings or ports 30 therein adapted for cooperation with perforations 31 in the belts 9 to provide a vacuum for pulling the bottom document in the document stack onto the belts 9. There are five rubber vacuum belts 9, the centre belt **9*a* being raised 2 mm above the four outer belts. This produces the corrugation when the document is pulled down by the vacuum. The frequency and size of the holes in the belts 9 regulates the volume of air that can be drawn through them. The transport belts 9 move across the top plate 29*a* of a vacuum plenum 29 which has the open slots or vacuum ports 30 in it coincident with the perforations in the belts. Once again the frequency and size of these slots 30 regulates the volume of air that can be drawn into the vacuum chamber beneath. Preferably no ports 30 are aligned with the centre belt 9*a* although it may for convenience of manufacture have the perforations 31** therein.

As can be seen from FIG. 2, the top plate **29*a* of the vacuum plenum chamber 29 is provided with a raised portion or ramp 32, 2 mm high, which lifts the centre belt 9*a* so that upon capture of the bottom document in the stack against belts 9, the center corrugation will be produced in the bottom sheet. Since the belts 9 extend through a dished portion or pocket 33 of document tray 3 so that they are below the surrounding support surfaces of the tray, the document is corrugated into a double valley configuration. The flat surfaces of the vacuum belts 9 on each side of the raised centre belt 9*a* generate a region of maximum stress in the document which varies with the document beam strength. In the unlikely event that more than one document is pulled down into contact with the feed belts, the beam strength of the second document resists the corrugating action; thus gaps are opened between sheets one and two which extend to their lead edges. These gaps and channels reduce the vacuum levels between sheets one and two due to porosity in sheet one and provide for entry of the separating air flow from the air knife. The air knife 10 comprised of pressurised air plenum 34 having a plurality of air jet openings 35 is provided to inject air into the pocket formed between the document pulled down against the feed belts 9 and the documents thereabove to provide an air cushion or bearing between the stack and the bottom document to minimize the force necessary for removing the bottom document from the stack. It can be understood that if two documents are pulled down toward the belts 9**, since the top sheet would not be corrugated, the air knife would inject air into the space between the two documents and force the second document off from the raised belt back toward the document stack.

The sidewalls of the document tray 3 are vented to allow air to escape and prevent arched inflation of the stack with its resultant multifeeds. The trail edge of the tray is also vented to improve sheet stability and turbulent lift of document trail edges.

To further increase the efficiency of the system, the document tray 3 is, as mentioned above, provided with a rearward tilt as seen in FIG. 1. When flotation air is provided under the stack or between the first and second sheets, gravity will allow the sheets to settle or float back against the rear tray wall. Thus, the sheet being removed is pulled uphill while gravity helps hold the remainder of the sheets back, helping to prevent multifeeds.

Within the vacuum plenum chamber 29 is housed a vacuum flap valve 36 which regulates the timing of the vacuum through the slots 30 in the top plate and belts and hence the acquisition timing of documents. The valve 36 is actuated by a shaft which passes through the side wall of the vacuum housing and is attached to a solenoid 37. A vacuum relief valve 38 is also positioned in one of the vacuum chamber side walls. It is actuated by the chamber pressure, and allows air to the air knife 10, when a document has been acquired by the vacuum transport and effectively closed off the inlet ports 30 to the vacuum chamber 29.

Beneath the vacuum chamber is a scroll-shaped impeller housing 39 containing an impeller. The impeller is driven by a motor 42 through a belt drive 43. Air drawn through the vacuum transport belts 9 and the vacuum chamber 29 is exhausted and ducted to the air knife 10 which is located above the lead edge of the document tray. A pressure relief valve 40 is situated in the duct 41 to control air knife pressure which would otherwise cause document 'blow away' prior to the closed inlet port condition.

By suitable controls, it is desirable to provide a delay between the time the vacuum is applied to pull the document onto the sheets and the start up of the feed belts to assure that the bottom document is captured on the belt before belt movement commences and to allow time for the air knife 10 to separate the bottom sheet from any sheets that were pulled down with it.

As explained above, when the bottom document is pulled into the pocket 33 and corrugated, an envelope type opening or pocket 70 is created between the bottom sheet and the remainder of the sheets in the stack. Air injected into this space from the air knife 10 produces an air bearing between the bottom sheet and the remainder of the stack to allow easy removal of the bottom sheet from beneath the stack. Flow of air from the pocket is restricted by a partial seal or flow restriction caused by supporting the major portion of the stack weight on the edge portions of the tray surrounding the pocket. Normally such corrugation and air injection is sufficient to promote separate feeding of the bottom sheet. However, where the lead edges of the document sheets are curled downwardly there is a tendency for the sheets to become shingled. This is because of the increased friction due to the downcurl and because the curl tends to inhibit the flow of air from the air knife 10 between the bottom sheet and the next sheet. As the shingling occurs the latter effect is increased since the lead edges of the sheets approach closer to and even pass under the air knife. This problem is more pronounced at slower sheet feed speeds such as those required for feeding documents at a controlled speed to the platen for feeding in constant velocity mode across the stationary optics. Where documents can be fed at a higher speed, e.g. when they are copied after registering them in the platen, the problem is less probably due to the higher inertia.

In order to overcome this problem a pair of narrow ramps 52 are arranged at the front end of the support surface. Each ramp 52 is arranged adjacent the pocket 33 and slopes upwardly in the direction of sheet feed. As illustrated schematically in FIG. 4, the ramps project forwards beyond the normal lead edge stacking position of sheets in the tray. When a sheet with downcurl is stacked in the tray it has limited beam strength across the tray and such sheets would normally tend to sag down into the pocket. The ramps not only raise the lead edges of the sheets above the surface 50 of the tray buy may improve the transverse beam strength of the sheets both of which promote improved air injection.

In a preferred embodiment the ramps 52 are 30 to 34 mm long and 4 mm wide and slope upwardly at an angle of approximately 5° to a height of 3 to 4 mm above the surface 50; they project about 4 to 5 mm beyond the lead edge 51 of the support surface 50 and are spaced 230 mm apart at the edges of the contour pocket 33.

In another embodiment illustrated in FIG. 5, the pocket 33 has a generally semi-circular shape and the vacuum feed belts 9 are differently positioned.

A third embodiment is illustrated in FIGS. 6 to 8 in which the pocket 33 has a somewhat different configuration with the surface portions 50 at each side of the pocket sloping downwardly towards the pocket which narrows rearwardly from the front end of the tray and then expands more gently, sloping wing portions 33*a* being formed near the front of the pocket which is deepest at the lead edge of the tray. The vacuum belt feeder 5 is arranged as shown in FIG. 6 and the belts 9 are seen in FIG. 8. The ramps 52 are either narrow members arranged at each side of the pocket as shown in FIG. 8, where the bottom sheet S1 has been pulled down against the belts 9, or wide ramps extending across the front edges of surface portions 50 as shown in FIG. 6. In both cases the ramps have the cross-section shown in FIG. 7 with a sharply sloping rear edge and a more gently sloping top surface.

Although a particular embodiment has been described it will be understood that various modifications may be made to the specific details referred to herein without departing from the scope of the invention as defined in the appendant claims. For example while the vacuum separator feeder is described in the environment of a document handler it may be used for feeding sheets in other environments.

What is claimed is:

1. In a bottom sheet feeding apparatus for separating the bottommost sheet in a stack of sheets and feeding it in a forward direction comprising a bottom sheet separator feeder and a sheet stacking tray having a planar base portion defining a base plane, the front of said base portion having an opening within which said bottom sheet separator feeder may be positioned to feed the bottommost sheet of a stack of sheets when sheets are in said sheet stacking tray, said sheet stacking tray further comprising two sloping planar side wings, one at each side of said opening in said base portion, said sloping planar side wings being angled upward from the base plane and being angled outward from front to rear of said tray, and each sloping planar side wing intersecting said base plane along a line from a point of the rear of the base in the approximate location of the rear corners of a rectangle the size of a sheet to be fed to a point at the front of the tray approximately midway between the front corners of a sheet to be fed and the centerline of a sheet to be fed, the improvement comprising:

raising means positioned on each of said sloping side wings for lifting the lead edges of downcurled sheets above said planar base portion of said stacking tray and thereby enhancing the feeding of the downcurled sheets.

2. A bottom sheet separator feeder according to claim 1, in which said raising means projects forwardly of the normal lead edge position of sheets stacked in the tray.

3. A bottom sheet separator feeder according to claim 1, in which said raising means comprises surfaces which slope upwardly in the feed direction.

4. A bottom sheet separator feeder according to claim 3, in which said raising means comprises narrow ramps.

5. A bottom sheet separator feeder according to claim 3, in which said raising means comprises ramps which extend across the front end of each of said sloping planar side wings.

* * * * *